United States Patent [19]

Wallin et al.

[11] Patent Number: 4,711,184

[45] Date of Patent: Dec. 8, 1987

[54] ARRANGEMENT FOR A DESK COMPRISING A DESK-TOP WHICH CAN BE RAISED AND LOWERED

[76] Inventors: P. O. Thomas Wallin; Bengt H. Warell; A. Pedar Svensson, all of Televerket, S-123 86 Farsta; Kurt A. Lundström, Televerket Industridivisionen, Svedjev 12, S-931 36 Skellefteå ; Lars A. Johansson, Kamomillgången 25, 61145 Nyköping, all of Sweden

[21] Appl. No.: 803,759

[22] Filed: Nov. 18, 1985

[30] Foreign Application Priority Data

Mar. 16, 1984 [SE] Sweden ..... 8401480

[51] Int. Cl.[4] ..... A47B 9/00

[52] U.S. Cl. ..... 108/144; 108/147; 248/161; 248/404

[58] Field of Search ..... 108/144, 147; 248/188.4, 188.2, 404, 161

[56] References Cited

U.S. PATENT DOCUMENTS

| | | | |
|---|---|---|---|
| 2,979,857 | 4/1961 | Longbotham | 248/542 |
| 3,080,835 | 3/1963 | Guglielmi | 108/147 X |
| 3,410,232 | 11/1968 | Kroeger | 108/144 X |
| 3,999,492 | 12/1976 | Emrick | 108/144 |
| 4,101,005 | 7/1978 | Fewkes | 248/404 X |
| 4,139,175 | 2/1979 | Bauer | 248/404 |
| 4,183,689 | 1/1980 | Wirges et al. | 108/144 X |
| 4,302,962 | 12/1981 | Williams | 248/188.4 X |
| 4,374,497 | 2/1983 | Harmand | 108/147 X |

FOREIGN PATENT DOCUMENTS

| | | | |
|---|---|---|---|
| 1429497 | 11/1968 | Fed. Rep. of Germany | 108/144 |
| 2134442 | 2/1973 | Fed. Rep. of Germany . | |
| B417394 | 3/1981 | Sweden . | |

*Primary Examiner*—James T. McCall

*Attorney, Agent, or Firm*—Pollock, Vande Sande & Priddy

[57] ABSTRACT

An adjustable switchboard desk has a top which can be raised and lowered by at least two telescopic legs. In each telescopic leg a hydraulic cylinder and its associated piston are arranged. The cylinder is fixed to the desk-top and the piston is fixed to an outer part of the telescopic leg, or vice versa. The inner and outer parts of the respective telescopic legs are made of closed profile with longitudinally extending, mutually co-acting guide surfaces.

4 Claims, 9 Drawing Figures

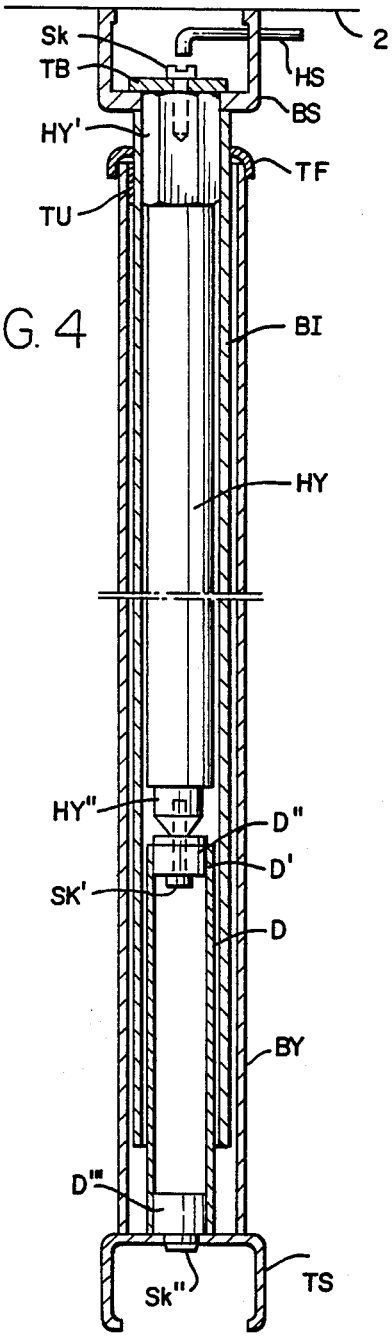
FIG. 4
FIG. 2
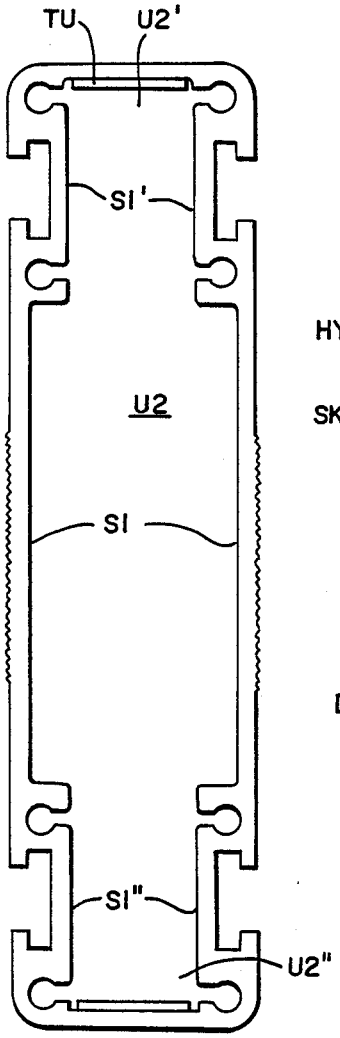
FIG. 3
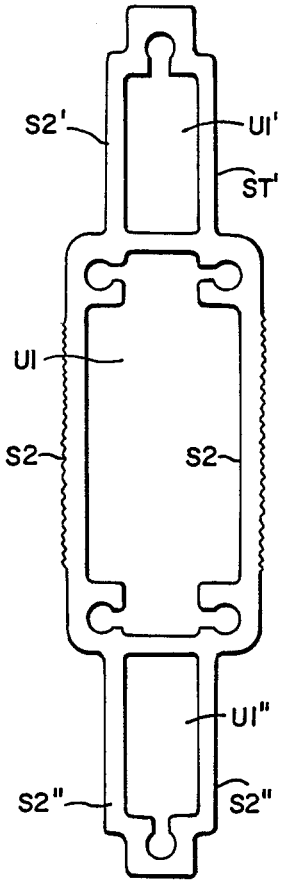

ARRANGEMENT FOR A DESK COMPRISING A DESK-TOP WHICH CAN BE RAISED AND LOWERED

TECHNICAL FIELD

The present invention relates to an arrangement for a desk comprising a desk-top which can be height-adjustable and is provided with telescopic legs to enable the top to be raised and lowered. The desk has at least two telescopic legs but can have three or more legs. The desk is further provided with devices for effecting the raising and lowering of the desk-top. These devices can be automatic or manual by operator; in the case of manual devices the raising and lowering can be accomplished by a crank or similar device.

It is already known in the art to provide a desk, for example a switchboard desk for office use, with an arrangement for raising and lowering the desk-top. It is also known to use telescopic legs for such a desk, each provided with a hydraulic cylinder. In this case, the hydraulic cylinders are supplied with power through a hydraulic pump which can be actuated by a motor, for example an electric or hydraulic motor, and/or by manual actuating devices which may comprise a crank, as mentioned above.

SUMMARY OF THE INVENTION

With desks of this kind it is important to provide reliable operation of the raising and lowering of the desk-top. The movable parts in the telescopic legs should not display any tendency to become jammed together (the so-called jammed-drawer effect). It is also important that the raising and lowering be carried out with a minimum of noise and reliably from the functioning point of view, even when the desk-top is unevenly loaded, for example, when objects placed on the desk act asymmetrically on the desk-top. From the maintenance and installation point of view the desk should be constructed to meet the demands made upon it.

The main object of the present invention is to provide a desk arrangement which solves the problems indicated above in a satisfactory manner. According to the present invention, important features of the new arrangement are provision of at least two of the respective telescopic legs of the desk with a hydraulic cylinder together with its associated piston. The respective cylinders are fixed to the desk-top and the pistons are fixed to an outer part of the telescopic leg involved. The inner and outer parts of the telescopic legs are made of closed profiles with longitudinally extending, mutually co-acting guide surfaces, and that the respective hydraulic cylinders in the respective telescopic legs involved extend inside the closed profiles.

Specific embodiments of the desk arrangement according to the present invention deal in more detail with the construction of the parts concerned. Thus, the outer parts of the respective telescopic legs are fixed at the bottom to a first bar which forms a base part and extends in the depth direction of the desk. The bar is fitted with height-adjusting devices which co-act with a supporting surface on which the desk is set. In a preferred embodiment of the invention, the height-adjusting devices and the bar are designed so that the height can be adjusted from the upper side of the bar.

The inner parts of the respective telescopic legs are fixed to a second bar, similarly extending in the depth direction of the desk and fixed to the lower face of the desk-top. The first and second bars consist of an open profile, preferably with a substantially square or rectangular cross-section. The first bar which forms the base part has its open section directed downwardly towards the foundation on which the desk is set. The open section of the second bar is directed towards the underside of the desk-top. The space which is enclosed by the second bar and the lower surface of the desk-top is used to house the connecting line or connecting lines, i.e. the hydraulic pipeline or hydraulic pipelines for the hydraulic cylinder positioned in the leg. Opposite the open part of its profile the second bar is provided with a cut-out for the connecting pipeline or connecting pipelines. A cover plate is arranged releasably to cover the cut-out, and this cover plate forms an abutment surface for the hydraulic cylinders so that they do not act directly on the material of the desk-top.

In further feature of this embodiment the pistons in the respective hydraulic cylinders are connected through a distancing device to the first bar which is fixed to the respective outer part of the telescopic leg.

The respective base parts have one or more height-adjusting devices which are accessible from the upper side of the base part for operation.

Moreover, preferably means for enhancing the sliding effect are used, these being in the form of a device which is inserted in the upper portion of the respective outer leg parts, between the leg parts. The device has a low coefficient of friction. The device is fixed in one of the leg parts by means of a securing device, for example a screw. Tolerance take-up devices can be used with this screw so that the tolerances are kept advantageous for the reciprocal movements of the leg parts.

With the means proposed above a well-adapted raising and lowering function is provided for the desk-top. The design is relatively simple while at the same time a high degree of reliability is provided in operation and construction.

In conjunction with the embodiments of the present invention advantages are also afforded from the installation and maintenance point of view. The hydraulic cylinders are accessible for maintenance, for example for replacing packing rings and so on. To facilitate replacement work the second bar can be released and the leg bent out from the desk-top. The cover plate is then removed, so that the hydraulic cylinder is fully accessible.

A presently proposed arrangement which displays the significant characteristics of the invention is described below with reference to the accompanying drawings, in which

BRIEF DESCRIPTION OF THE DRAWINGS

FIG. 2 shows the profile shape of the outer part in the respective telescopic legs, FIG. 3 is a cross-section through a profile of an inner part in the respective telescopic legs, FIG. 4 is a longitudinal section showing the positioning of the hydraulic cylinder in the telescopic leg framed by the inner and outer parts.

DESCRIPTION OF THE PREFERRED EMBODIMENTS

Figure 1:
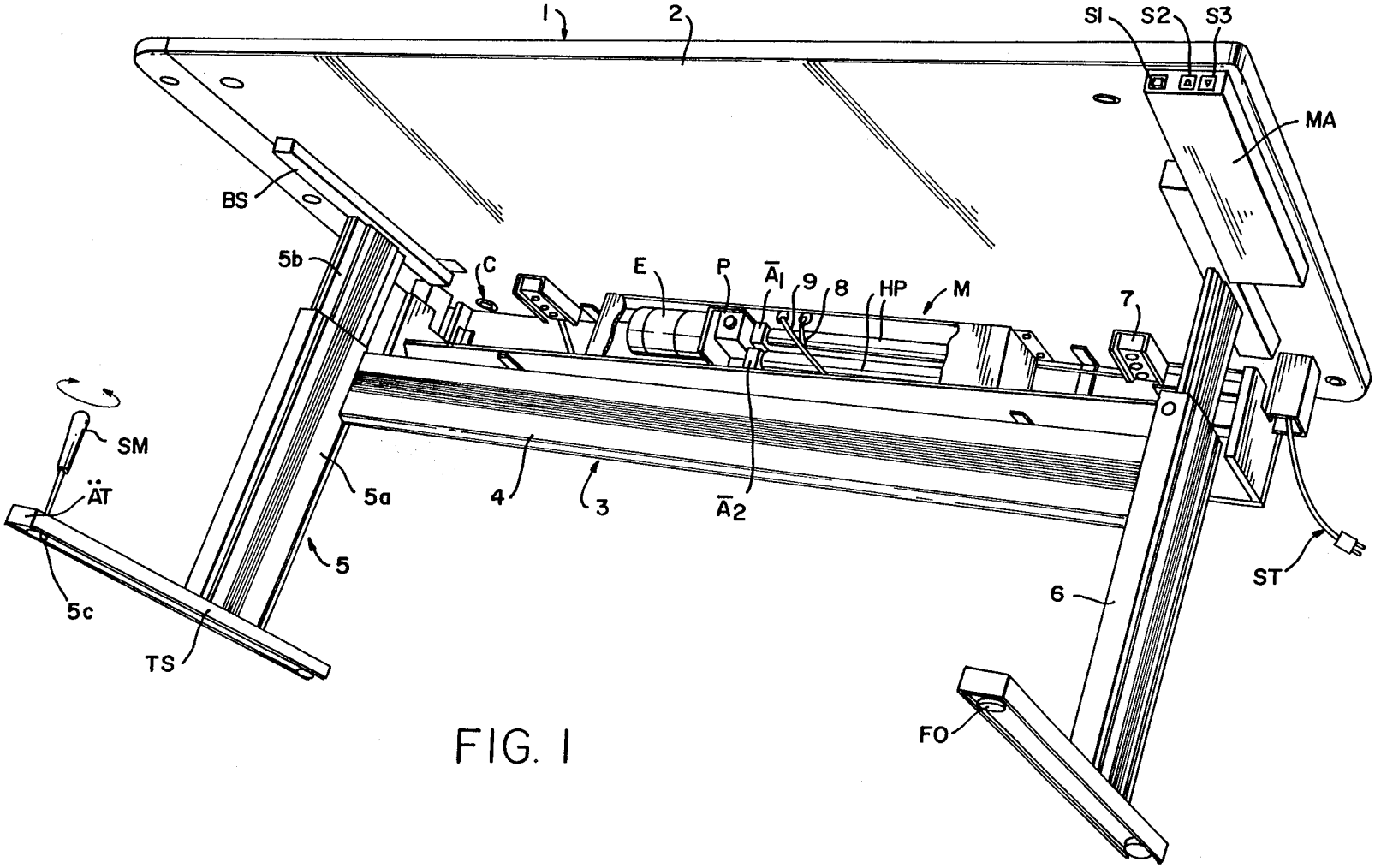
FIG. 1 is a perspective view taken from an angle below and to the right, showing the construction of the desk.

In FIG. 1 a desk which may consist of a switchboard desk is indicated by 1. The desk is made with a desk-top 2 and a framework 3 which comprises a crossbar 4 to the ends of which two telescopic legs 5 and 6 are connected. The respective telescopic legs comprise outer part 5*a* and inner part 5*b*. The outer part is provided at the bottom with a base part TS which is in the form of an open profile. The base part extends in the depth direction of the desk. The base parts are equipped with feet 5*c* which can be adjusted in the height direction and which are designed to co-act with a supporting surface on which the desk is set. The feet 5*c* may vary in number and may be two, three or more, for example. The base parts are provided with cover elements ÄT at their respective ends. These cover elements are provided mainly for the sake of the appearance. The desk-top 2 is fixed to the inner parts 5*b* through other profiles BS or bars.

The inner parts in the respective telescopic legs can be actuated by means of a hydraulic cylinder (not shown in FIG. 1) which is provided in each of the legs. The hydraulic cylinders can be arranged in a way which is described in more detail below, so that mutual displacement by means of the respective hydraulic cylinders can be effected by the leg parts 5*a* and 5*b*, thus raising and lowering the desk-top. The hydraulic cylinders in the telescopic legs can be supplied in a way which is known. In the present case at least one hydraulic pump HP is used (a so-called double pump). This hydraulic pump is disposed in a motor housing M on the lower face of the desk-top. The motor housing is disposed directly underneath the desk-top, and substantially in the central region thereof. The desk is also provided with a cable duct 6 and connecting devices 7 for connecting to an external electrical current source, for example for connecting to the conventional mains power supply. In this instance connection is made to a socket by a plug ST.

In addition to the pump HP, in the present embodiment the motor housing contains an electric motor E which drives the hydraulic pump 9. The hydraulic pump is in communication with the hydraulic cylinders in the telescopic legs through hydraulic pipelines 8 and 9. A potentiometer P and two limit switches Ä1 and Ä2 are arranged on the output shaft of the electric motor.

On the lower face of the top 2, towards the rear and directly out to the right-hand side, a control box MA is arranged for controlling the effective devices in the motor housing M. At its rear end the control box is provided with manual actuating devices K1, K2 and K3. The control box MA contains electronic equipment of a kind which is known and which is designed to control the electric motor and thus also the pump HP. In accordance with the control effected by this equipment, the pump in turn controls the hydraulic cylinders in the telescopic legs so that the desired raising and lowering actions of the desk can be effected.

The base parts TS on the respective telescopic legs are made from the same profile as the bars BS, but the base parts TS are longer. The bar profile is of the type which has an open, substantially rectangular or square cross-section, the open part of the profile facing downwardly in the case of the base parts 5*c*, and upwardly in the case of the bars BS. With the arrangement shown, the height-adjustment devices 5*c* are accessible from above with a screw-driver, hexagonal key or similar device SM which makes adjustment of the level of the desk considerably easier. The control box also contains indicating devices which are visible from the upper face of the desk (not shown in FIG. 1).

The outer and inner parts of the respective telescopic legs consist of closed profile as shown in FIGS. 2 and 3; FIG. 2 shows the profile for the outer part and FIG. 3 the profile for the inner part. The outer part is provided with longitudinal guide surfaces S1, S1', S1'' and the inner part is provided with corresponding guide surfaces S2, S2', S2''. The guide surfaces are elongated and are designed to counteract any jamming effect and thereby provide for satisfactory smooth and troublefree adjustment of the desk-top. The inner and outer parts are made as elongated narrow closed profiles which provide the necessary rigidity while at the same time are relatively light. According to FIG. 3, the inner leg part has a closed inner space U1 and the outer leg part shown in FIG. 2 has a closed inner space U2. The inner leg part is also provided with two smaller separate cavities U1' and U1'', while corresponding cavities U2' and U2'' in the outer part communicate with the inner space U2.

A hydraulic cylinder HY for the respective leg extends in the central inner spaces U1 and U2, as shown in FIG. 4. In the respective legs there is a distancing component D. The outer part BY is fixed directly to the bar TS which forms the base part. This fixing can be effected in a way which is known in the art. The inner leg part BI is fixed in a corresponding way to the bar BS which is fixed to the desk-top 2 in a manner known by means of screws (not shown in FIG. 4).

The hydraulic pipeline HS is connected through the upper parts of the cylinders and bars BS. Only some parts of the hydraulic pipeline are shown, for the sake of clarity. At the upper end of the outer leg part BY a sealing element TF is arranged so that it slides against the inner leg part BI. There is also a sliding arrangement TU between the leg parts, where rings can be provided to take up tolerances.

The bar BS is provided with a cut-out in the section opposite the open section of the bar profile. A cover plate TB is provided on this cut-out and can be screwed, for example with four screws SK, into a part HY'. The force of the hydraulic cylinder is thus delivered via the plate TB, which means that the hydraulic cylinder does not act directly on the material of the desk-top.

The hydraulic cylinders arranged inside the respective legs are readily accessible from the end. The bar BS is released from the desk-top and the leg can then be bent out so that access is not obstructed by the desk-top. The cover plate TB is unscrewed and removed, exposing the hydraulic cylinder.

The distancing component D adapts the length of the telescopic leg to the length of the hydraulic cylinder. At its upper end D' the distancing device is provided with a fixing device SK' through which the end HY'' of the piston is fastened to the end part D'' of the distancing device D.

At the bottom the distancing device is fixed to the bar TS. This fixing is effected by a fixing device SK'' which co-acts with bar TS and another end part D''' on the distancing device D.

The profile shown in FIG. 2 has an elongated, narrow, substantially rectangular cross-section. The profile shown in FIG. 3 has a cross-section which is composed of three substantially rectangular parts of which the central part forms a large rectangular part and the two remaining rectangular parts are substantially the same size as each other and are connected to the short ends of the first-mentioned rectangular part.

Figure 5:
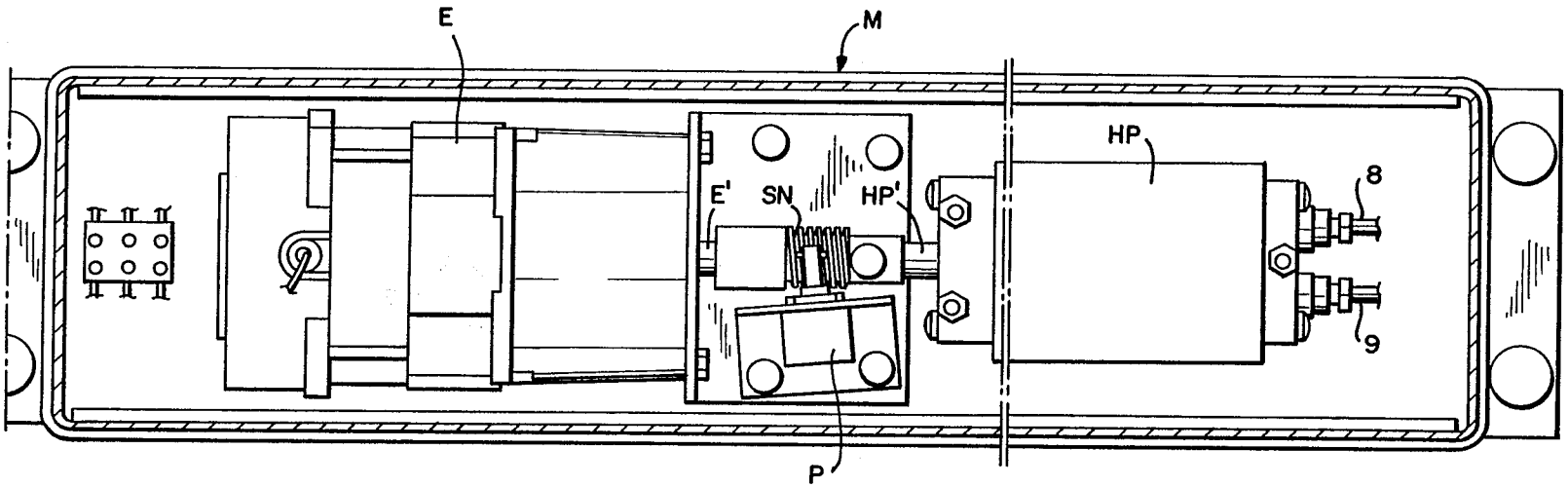
FIG. 5 is a horizontal view showing an example of a device for effecting height adjustment.

FIG. 5 shows the motor housing M with the electric motor E which may consist of a single-phase non-synchronous motor, and the hydraulic pump HP which may consist of a so-called double pump. The output shaft of the electric motor is indicated by E' and the drive shaft of the hydraulic pump is indicated by HP'. The potentiometer P is connected to transmission E', HP' through a helical thread SN. The potentiometer consits of a known 10-revolution potentiometer. The connecting pipelines 8, 9 for the hydraulic pump are also shown.

Figure 6:
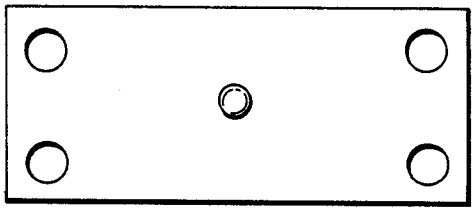
FIG. 6 is a horizontal view showing a cover plate on a fixing bar for the telescopic legs on the desk top.
Figure 7:
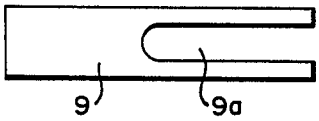
FIG. 7 is a horizontal view showing a tolerance take-up device provided on the respective telescopic legs.

FIG. 6 shows the cover plate TB mentioned above, in a horizontal view. FIG. 7 shows a tolerance take-up device, designated 9. These devices are made of thin, substantially uniformly thick plate. The device or plate is provided with a cut-out 9*a* through which the plate can be suspended on a fixing screw for the sliding part TU mentioned above.

Figure 8:
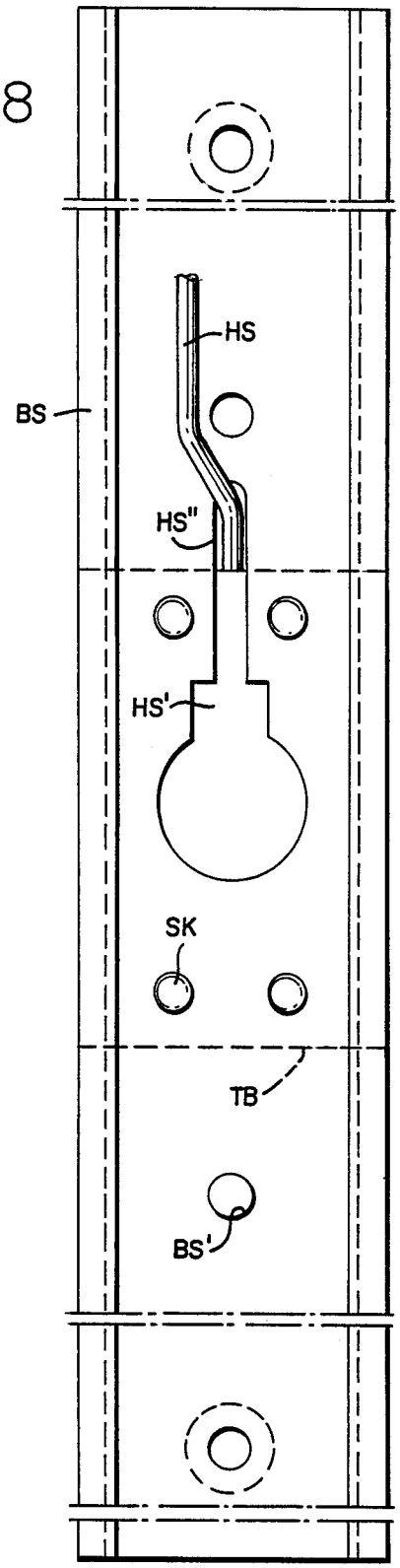
FIG. 8 is a horizontal view showing a bar which can be provided for the desk-top.

FIG. 8 is a horizontal view of the bar BS. The cut-out mentioned above is designated HS', and has exactly the same shape as a keyhole. As mentioned above, the cut-out is covered by the cover plate shown in FIG. 6, the position of the cover plate being shown with dashed lines in FIG. 8. The cover plate thus fixes the position of the hydraulic cylinder. The cover plate can be screwed on by four of the above-mentioned screws SK. The bar is also provided with a through-bore BS' for screws which hold the bar securely on the desk. The bores may be four in number. The cut-out HS' has a narrow part HS'' which is not covered by the plate when the latter is fitted on the bar. The part HS'' of the cutout which is left uncovered is designed to allow the introduction of the hydraulic pipeline or hydraulic pipelines HS.

Figure 9:
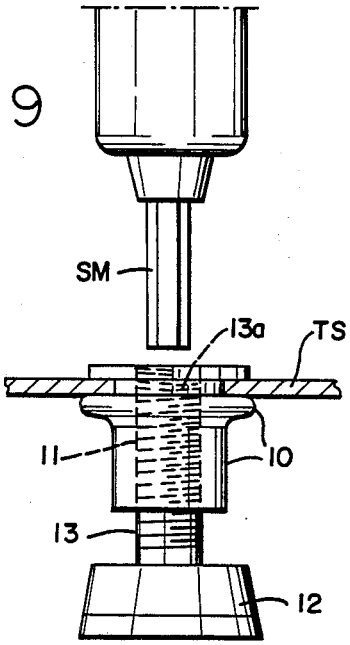
FIG. 9 is a vertical section showing a height-adjustment device which is accessible from above.

The basic construction of the height-adjustment device is shown in FIG. 9. A component 10 is fixed in a cut-out in the bar TS. The component is made with a tapped through-bore 11 which terminates at the upper surface of the bar TS. A foot 12 is screwed into the component through a threaded part 13 attached to the foot, which is provided at its upper end 13*a* with a groove (also a cross-groove), a key shank or the like through which a tool SM can be attached to screw the foot in or out relative to the component 13. The component can be made of a deformable material so that flanges 10*a* or similar can be provided for clamping around the material.

The invention is not limited to the embodiment illustrated above by way of example, but may be modified within the framework of the following patent claims.

We claim:

1. An improved height adjustable desk comprising:

a desk top;

at least two telescopic legs for raising and lowering said top with respect to a reference level, said telescopic legs having inner and outer parts;

a hydraulic cylinder including an associated piston extending inside each of said telescopic legs, said cylinder being fixed to the top and said piston being fixed to said outer part of said telescopic leg, said inner part being detachably connected to a first bar member releasably attached to the underside of the desk top;

means for actuating the hydraulic cylinders; and, wherein said inner and outer parts of said telescopic legs are made of closed profiles, an outer closed profile having a cross-section including a central substantially rectangular portion and two substantially rectangular side portions of reduced dimensions on each side of said central portion, and inner closed profile having a cross-section forming a corresponding central substantially rectangular portion and side portions on each side of said central portion, the inner walls of said central and side portions of said outer profile and outer walls of said corresponding central and side portions of said inner profile forming longitudinally extending mutually-coacting guiding surfaces counteracting jamming when said inner and outer parts are longitudinally movable with respect to each other for height adjustment of said desk.

2. A height adjustable desk according to claim 1 wherein the bottom of the outer part of said telescopic legs is secured to a base part formed by a second bar made of an upwardly open profile, said second bar being provided with height-adjusting device, said height-adjusting device and said second bar being accessible for height adjustment from upper side of said second bar.

3. A height adjustable desk according to claim 2 wherein said piston of said hydraulic cylinder is connected through a distancing device to said second bar for adapting the length of said telescopic leg to the length of the hydraulic cylinder.

4. A height adjustable desk according to claim 1 further comprising means for facilitating the sliding movement of said inner part relative to said outer part provided at the upper region of said outer part and including means for adjusting tolerances.

* * * * *